US009816377B2

(12) United States Patent
Voight et al.

(10) Patent No.: US 9,816,377 B2
(45) Date of Patent: Nov. 14, 2017

(54) HYDRAULIC AXIAL-PISTON DEVICE WITH FEATURES TO ENHANCE EFFICIENCY AND POWER DENSITY

(71) Applicant: EATON CORPORATION, Cleveland, OH (US)

(72) Inventors: Michael Joseph Voight, Excelsior, MN (US); Yilmaz Bayazit, St. Louis Park, MN (US)

(73) Assignee: Eaton Corporation, Cleveland, OH (US)

( * ) Notice: Subject to any disclaimer, the term of this patent is extended or adjusted under 35 U.S.C. 154(b) by 81 days.

(21) Appl. No.: 14/864,172

(22) Filed: Sep. 24, 2015

(65) Prior Publication Data

US 2016/0084084 A1 Mar. 24, 2016

Related U.S. Application Data

(60) Provisional application No. 62/054,583, filed on Sep. 24, 2014.

(51) Int. Cl.
*F01B 3/00* (2006.01)
*F04B 1/20* (2006.01)

(52) U.S. Cl.
CPC ..... *F01B 3/007* (2013.01); *F04B 1/2035* (2013.01); *F04B 1/2064* (2013.01); *F04B 1/2078* (2013.01); *F04B 1/2085* (2013.01)

(58) Field of Classification Search
CPC ..... F04B 27/1072; F04B 27/22; F01B 3/105
USPC ..... 92/13, 71
See application file for complete search history.

(56) References Cited

U.S. PATENT DOCUMENTS

| | | | | |
|---|---|---|---|---|
| 2,424,660 | A | 7/1947 | Howard | |
| 2,910,845 | A | 11/1959 | Wahlmark | |
| 2,917,931 | A * | 12/1959 | Sherman | F01B 3/0023 74/55 |
| 2,918,012 | A * | 12/1959 | Lucien | F04B 1/146 417/270 |
| 3,013,411 | A | 12/1961 | Wahlmark | |
| 3,040,532 | A | 6/1962 | Thoma | |
| 3,137,243 | A | 6/1964 | Beck | |
| 3,186,352 | A | 6/1965 | Anderson | |
| 3,426,686 | A | 2/1969 | Anderson | |
| 3,761,202 | A * | 9/1973 | Mitchell | F04B 27/1054 417/269 |
| 4,232,587 | A * | 11/1980 | Kline | F04B 1/2035 91/499 |
| 4,487,108 | A | 12/1984 | McLuen | |
| 5,055,004 | A * | 10/1991 | Ebbing | F04B 27/1804 417/222.2 |

(Continued)

FOREIGN PATENT DOCUMENTS

GB 702596 1/1954

*Primary Examiner* — Thomas E Lazo
(74) *Attorney, Agent, or Firm* — Merchant & Gould P.C.

(57) ABSTRACT

An axial piston device configuration that includes a drive shaft, a piston block, pistons, a constant velocity joint assembly, a drive plate coupled to the constant velocity joint assembly, a swash plate, shoes, and piston rods may be provided. The piston block has an interior that is coupled to the drive shaft via a first torque transmitting mechanical interface. The constant velocity joint assembly includes multiple components, at least one of which is coupled to the drive shaft via a second torque transmitting mechanical interface.

14 Claims, 5 Drawing Sheets

(56) References Cited

U.S. PATENT DOCUMENTS

| | | | | | |
|---|---|---|---|---|---|
| 5,079,996 | A * | 1/1992 | Abousabha | F04B 1/324 | 417/222.1 |
| 5,112,197 | A * | 5/1992 | Swain | F04B 27/1072 | 417/222.2 |
| 5,129,752 | A * | 7/1992 | Ebbing | F04B 27/1063 | 403/114 |
| 5,752,413 | A * | 5/1998 | Kuhn | F04B 1/146 | 417/269 |
| 6,553,890 | B2 * | 4/2003 | Ahn | F04B 27/1072 | 92/12.2 |
| 7,546,797 | B2 * | 6/2009 | Betz | F04B 1/126 | 92/57 |
| 8,202,058 | B2 * | 6/2012 | Lindholdt | F01B 3/0044 | 324/624 |
| 8,327,751 | B2 * | 12/2012 | Tagami | F04B 27/1063 | 91/505 |
| 8,549,985 | B2 * | 10/2013 | Tagami | F04B 27/1063 | 417/222.1 |
| 8,997,631 | B2 * | 4/2015 | Tagami | F04B 27/0895 | 92/12.2 |
| 2011/0229348 | A1 * | 9/2011 | Honda | F04B 27/1072 | 417/270 |
| 2014/0360351 | A1 * | 12/2014 | Iwanaji | F04B 1/2021 | 92/13 |
| 2015/0300333 | A1 * | 10/2015 | Numaguchi | C22C 9/02 | 92/13 |

* cited by examiner

HYDRAULIC AXIAL-PISTON DEVICE WITH FEATURES TO ENHANCE EFFICIENCY AND POWER DENSITY

CROSS-REFERENCES TO RELATED APPLICATIONS

This application claims the benefit of U.S. Provisional Application No. 62/054,583, filed Sep. 24, 2014, the entire contents of which are incorporated by reference herein.

TECHNICAL FIELD

The present disclosure relates generally to hydraulic devices such as axial-piston pumps/motors.

BACKGROUND

Hydraulic systems typically convert power between mechanical and hydraulic forms. Common types of hydraulic systems include hydraulic pumps, hydraulic motors, hydraulic cylinders, control valves, hydraulic accumulators and other components.

Some advantages of utilizing hydraulic systems include power density, continuously variable power transmission, a stiff dynamic response, flexible connections, and more. Although hydraulic systems exemplify many advantages over other power transmitting and control devices, these systems are also known for several drawbacks. Some drawbacks include a requirement for fine tolerances in the design and manufacture, utilizing the hydraulic fluid as lubrication under intense temperature conditions, and finally system efficiency.

FIG. 1 illustrates an example prior art axial-piston pump 10. The axial-piston pump 10 includes a drive shaft 11 coupled to a piston block 17 by a splined connection such that the drive shaft 11 and the piston block 17 rotate as a unit about a central longitudinal axis 9 of the drive shaft 11. The piston block 17 defines a plurality of cylinders 16 that receive pistons 12. The pistons 12 include elongated body portions 15 that reciprocate linearly within the cylinders 16. The elongated shape of the body portions 15 facilitates the transfer of torque between the piston block 17 and the pistons 12. The pistons 12 also include heads 19 secured within hydrostatic shoes 18 mounted within pockets defined by a carrier plate 14. The hydrostatic shoes 18 bear against a swash plate 13 that can be pivoted relative to the drive shaft 11 to vary the stroke length and thus the volumetric displacement of the axial-piston pump 10 at a given rotational speed of the drive shaft 11. In operation, torque from the drive shaft 11 is transferred through the piston block 17 and the pistons 12 to the hydrostatic shoes 18 thereby causing them to rotate relative to the swash plate 13 about the central longitudinal axis 9. As this group of components rotates, torque is resolved into axial pumping forces on the pistons 12 due to a non-zero swashplate angle. The transfer of pumping torque from the piston block 17 through the pistons 12 and the hydrostatic shoes 18 causes side load to be applied to the pistons 12 at the interface between the pistons 12 and the hydrostatic shoes 18. This side loading can cause the elongated body portions 15 of the pistons 12 to skew within their corresponding cylinders 16 thereby producing drag that can reduce the operating efficiency of the axial-piston pump 10. Improvements in this area would be beneficial.

SUMMARY

Teachings of the present disclosure relate to a hydraulic axial-piston device (e.g., a hydraulic pump or motor) having features for enhancing operating efficiency. Teachings of the present disclosure also relate to a hydraulic axial-piston device (e.g., a hydraulic pump or motor) having features for enhancing power density Teachings of the present disclosure relate to axial-piston devices having features for enhancing mechanical efficiency by reducing or eliminating side loading applied to the pistons during operation thereby reducing drag related friction that may occur at the interface between the pistons and the piston block.

Teachings of the present disclosure relate to axial-piston devices having features for reducing or eliminating the amount of axial displacement torque that is transferred through the lengths of the pistons. As used herein, "axial displacement torque" is torque from the drive shaft that is resolved into axial pumping force in the case of a pump, or torque resolved from axial-piston force and transferred to the drive shaft in the case of a motor.

Teachings of the present disclosure also relate to axial-piston devices having relatively short pistons and relatively slender connecting rods that extend from the pistons to hydro-static shoes mounted within a drive plate. This type of configuration reduces geometric constraints to pivoting (i.e., interference points) and can provide enhanced power density by allowing the swash plate angle to be maximized. In certain examples, the configuration prevents or limits axial displacement torque from being transmitted though the lengths of the connecting rods.

Teachings of the present disclosure relate to an axial-piston device including a piston block and a drive plate that both are coupled to a drive shaft by torque transmitting interfaces such that angular misalignment between the piston block and the drive plate is prevented. The drive plate is supported on a swash plate by hydrostatic shoes. The swash plate can be pivoted relative to the drive shaft to allow a stroke length of the axial-piston device to be changed. The drive plate, the drive shaft and the piston block are configured to rotate relative to the swashplate. Piston rods have first ends secured to pistons disposed in cylinders of the piston block and second ends secured to the hydrostatic shoes. Axial displacement torque is transferred between the drive plate and the second ends of the piston rods through the hydrostatic shoes. The hydrostatic shoes are configured such that axial displacement forces resolved into or from torque are not applied to the drive plate. Instead, such axial displacement forces bypass the drive plate and are applied to the swash plate through fluid bearings corresponding to the hydrostatic shoes. From the swash plate, such axial displacement loads can be transferred to a housing of the axial-piston device. In this way, the axial displacement forces are prevented from applying bending moments to the drive shaft that would need to be accommodated by relatively large and expensive bearings. In certain examples, the second ends of the piston rods can be coupled to the hydrostatic shoes at universal joints, and a torque transfer plane of the drive plate can be oriented to intersect center points of the universal joints. Such a configuration resists tipping of the hydrostatic shoes relative to the swash plate. In certain examples, a constant velocity joint is used to couple the drive plate to the drive shaft. The constant velocity joint allows torque to be transferred between the drive shaft and the drive plate, and also allows the drive plate to pivot with the swash plate relative to the drive shaft. The swash plate can be supported on a pivot cradle coupled to the housing of the axial-piston device. In certain examples, the pistons can be relatively short in length and the piston rods can be relatively slender so as to reduce geometric constrains to pivoting of the drive plate and the swash plate. This can allow for maximization of the swash plate angle to increase a power density of the axial-piston device.

Teachings of the present disclosure relate to an axial-piston pump. The pump includes a drive shaft that rotates about a longitudinal drive axis and a piston block coupled to the drive shaft by a first torque transmitting mechanical interface. This coupling of the drive shaft and the piston block enables the piston block to rotate with the drive shaft about the longitudinal drive axis. The piston block includes more than one cylinder. Each cylinder includes a piston that is reciprocally moveable within the cylinder.

The axial-piston pump also includes a constant velocity joint, configured to include an inner race, an outer race, and balls positioned between the inner and outer races. The inner race is coupled to the drive shaft by a second torque transmitting interface. This coupling of the inner race to the drive shaft enables the constant velocity joint to rotate with the drive shaft about the longitudinal drive axis. The balls within the constant velocity joint transfer torque from the inner race to the outer race. In addition, the balls enable the outer race to pivot relative to the inner race and the drive shaft. The axial-piston pump also includes a drive plate coupled to the outer race of the constant velocity joint, enabling the drive plate to rotate with the constant velocity joint about the longitudinal drive axis. The drive plate is mounted to pivot with the outer race relative to the drive shaft.

The drive plate also includes shoe pockets. The axial-piston pump includes hydrostatic shoes positioned within the shoe pockets and carried with the drive plate. The axial-piston pump also includes a swash plate enabled to pivot with the drive plate and the outer race relative to the drive shaft. The hydrostatic shoes are enabled to provide a bearing interface with the swash plate. The swash plate is not rotatable with the drive shaft. The swash plate may be supported by a cradle that is secured to a housing of the axial-piston pump. The cradle may enable the swash plate to pivot relative to the drive shaft. The swash plate may also include a convex portion that engages a corresponding concave portion of the cradle.

The axial-piston pump also includes piston rods mounted to universally pivot within the pistons by first heads of the piston rods. Second heads of the piston rods are mounted to universally pivot within the hydrostatic shoes. A torque transfer plane of the constant velocity joint may intersect with the second heads of the piston rods. The second heads may include spherical portions that mount within spherical pockets defined by the shoes. The shoes may include spherical drive plate engagement portions that engage corresponding spherical shoe engagement portions defined by the drive plate at a shoe-to-drive plate engagement region. The pockets of the drive plate may also include non-spherical portions. Space (e.g., gaps) may be defined between the shoes and the non-spherical portions such that the shoes do not contact the drive plate at a non-engagement region corresponding to the non-spherical portions of the pockets of the drive plate. A torque transfer plane of the constant velocity joint may intersect the shoe-to-drive plate engagement region.

The piston rods define longitudinal fluid passages that provide fluid communication between the cylinders and the shoes. Fluid bearings are defined between the shoes and the swash plate at the bearing interface. The shoes define shoe fluid passages that provide fluid communication between the longitudinal fluid passages of the piston rods and the fluid bearings such that the fluid bearings are pressurized by fluid pressure from the cylinders.

Aspects of the present disclosure relate to improving overall efficiency of the axial-piston pump. For example, since the constant velocity joint and the piston block are receiving transmitted torque from the drive shaft by the first and second torque transmitting mechanical interfaces both the constant velocity joint and the piston block are angularly aligned with one another. Since the pistons are not transmitting torque from the piston block, the pistons can be shortened significantly, and can incorporate second heads mounted to universally pivot within the shoes. As a result, any side load acting on the piston is significantly reduced, significantly improving the efficiency of the axial-piston pump.

Another aspect of the present disclosure relates to improving the power density within the axial-piston pump configuration. Teachings of the present disclosure also allow for increasing the maximum allowable swashplate angle, producing a correspondingly larger pump displacement that translates greater flow at the same shaft speed.

A variety of additional aspects will be set forth in the description that follows. The aspects can relate to individual features and to combinations of features. It is to be understood that both the forgoing general description and the following detailed description are exemplary and explanatory only and are not restrictive of the broad concepts upon which the examples disclosed herein are based.

BRIEF DESCRIPTION OF THE DRAWINGS

The accompanying drawings, which are incorporated in and constitute a part of this disclosure, illustrate various examples of the present disclosure. In the drawings.

DETAILED DESCRIPTION

Figure 1:
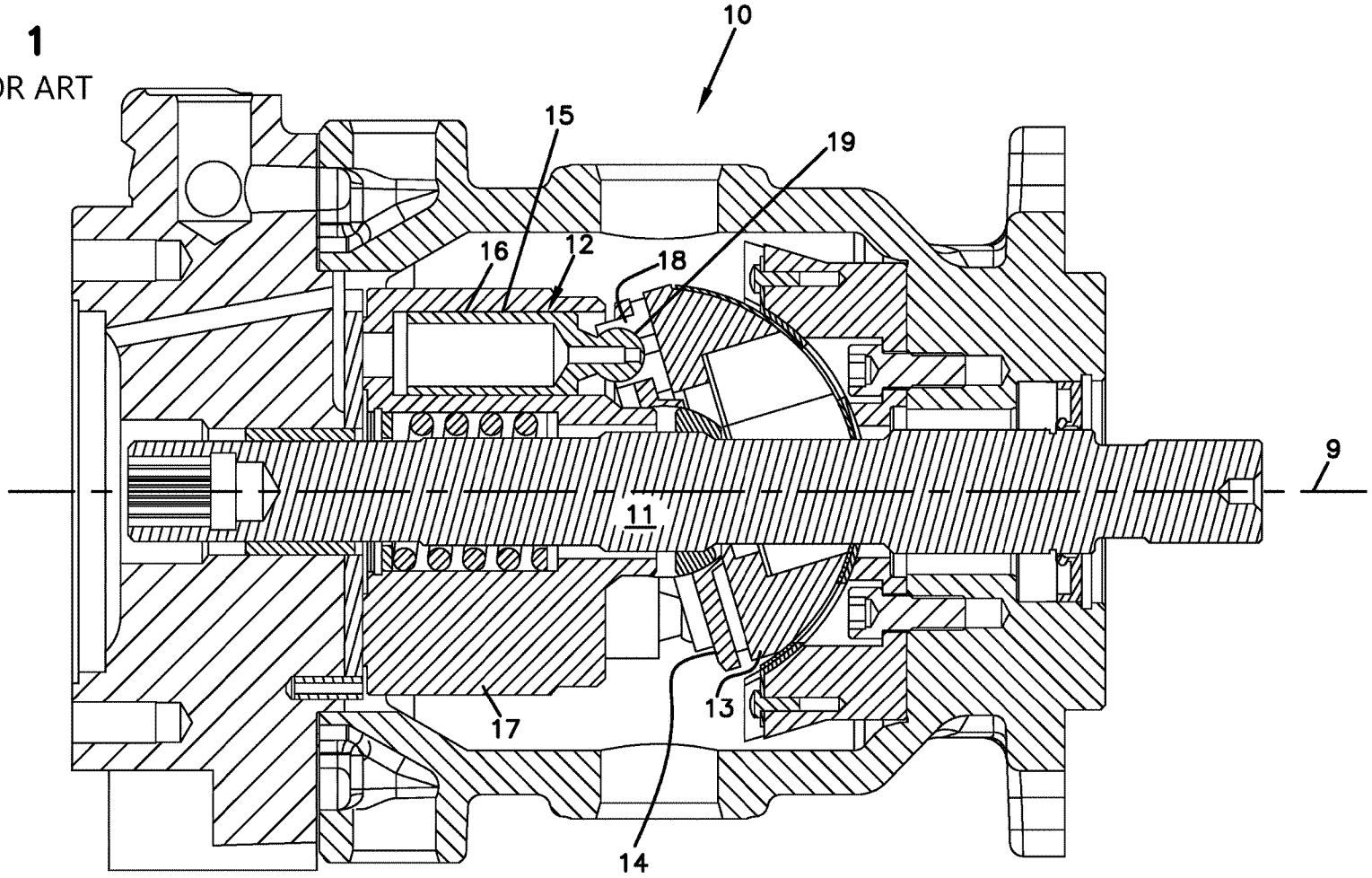
FIG. 1 PRIOR ART
FIG. 1 is a cross-section view showing a prior art axial-piston pump.

Aspects of the present disclosure relate to hydraulic axial-piston devices such as axial-piston pumps and axial-piston motors. For ease of explanation, the present specification refers primarily to axial-piston pumps. However, one of skill in the art will readily appreciate that the various teachings are equally applicable to both hydraulic pumps and motors.

Aspects of the present disclosure relate to an axial displacement pump incorporating a constant velocity joint (CVJ) into the pump design. Input torque to the pump can be transmitted from the drive shaft through the constant velocity joint, via a drive plate that is integrated into the constant velocity joint, to hydrostatic shoes with the drive plate. Torque on the hydrostatic shoes is resolved into an axial pumping force applied to pistons of the axial-piston pump due to a non-zero swash plate angle. The pistons are mounted to reciprocate within a piston block. Torque is also transmitted to the piston block from the drive shaft. However, significant torque is not transmitted to the pistons through the piston block. In certain examples, torque to both the constant velocity joint and the piston block can be transmitted by the same spline on the drive shaft. This keeps both components angularly aligned with each other. Since the pistons are not required to transmit torque from the piston block, they can be shortened significantly. In certain examples, the pistons have piston lengths that are less than one half or less than one third or less than one quarter of cylinder lengths of their corresponding cylinders defined by the piston block. A ball-socket joint can be incorporated into the pistons with a slender connecting rod that connects the pistons to the hydrostatic shoes. The slender connecting rods preferably do not contact the piston block, since no torque is being transmitted at this interface. In certain examples, side load on the pistons is greatly reduced due to aspects of the present disclosure, thereby enhancing the efficiency of the pump. In certain aspects of the present disclosure, the use of hydrostatic shoes at the drive plate allows axial force on the connecting rods due to load pressure to be decoupled from the drive shaft. In this way, bending load is prevented from being applied to the drive shaft. Instead, the reaction of the hydrostatic shoes is taken up by the swash plate, which in turn passes the reaction into the pump housing.

Other aspects of the present disclosure allows for increased pump displacement for a given package size. Configurations in accordance with the principles of the present disclosure reduce potential geometric interference of the hydrostatic shoe with the mouth of the piston block bore or between the drive shaft and the shoe retention mechanism. Additionally, by limiting or eliminating piston side load stresses, the maximum swash plate angle can be increased without generating stress on the piston in excess of the safe limit for the material of the piston. In the present disclosure, using a constant velocity joint, the maximum allowable swash plate angle can be maximized, producing a correspondingly larger displacement that translates into greater flow at the same shaft speed. It will be appreciated that the constant velocity joint allows the swash plate to be articulated to relatively large angles. Additionally, the short pistons in conjunction with the slender connecting rods avoids geometric interference issues commonly encountered with standard axial pumps. Furthermore, since no meaningful torque is being transmitted through the connecting rods and pistons (except for a small torque that is produced due to friction at the ball socket joints), bending stress in the connecting rods is negligible. These factors allow the power density of pumps in accordance with the present disclosure to be maximized.

In certain examples of the present disclosure, the axial-piston pump incorporates a constant velocity joint, enabling torque transfer from the drive shaft to the constant velocity joint via a special drive plate that is integrated into the constant velocity joint, to hydrostatic shoes. The torque on the hydrostatic shoes is resolved into an axial pumping force on the pistons due to the non-zero swashplate angle. The torque to both the constant velocity joint and piston block is transmitted by the same spline on the drive shaft. Therefore, pistons incorporated within the axial-piston pump do not transmit torque, and as a result eliminate any side load between the piston and the bore.

Figure 2:
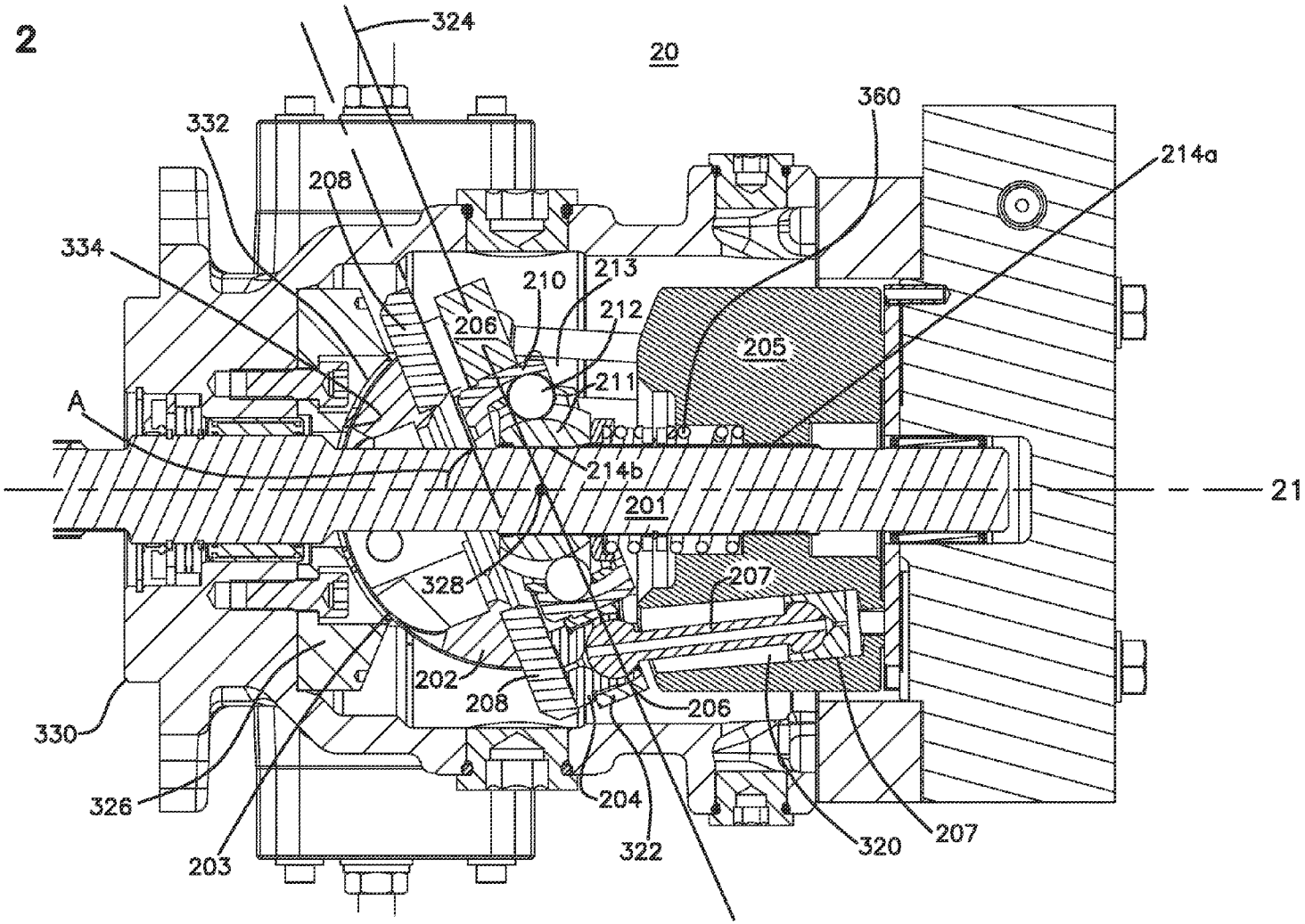
FIG. 2 is a cross-section of an axial-piston pump in accordance with the principles of the present disclosure.

Referring now to the drawings, FIG. 2 depicts an axial-piston pump 20 assembly in accordance with the principles of the present disclosure. The axial-piston pump 20 assembly includes a drive shaft 201, a piston block 205, pistons 207, a constant velocity joint 213, a drive plate 206, a swash plate 208, and piston shoes 204 (e.g., hydrostatic shoes or slippers). The drive shaft 201 rotates about a longitudinal axis 21. Both the piston block 205 and the constant velocity joint 213 are coupled to the drive shaft 201 to ensure both components are driven at the same speed. Driving both the piston block 205 and the constant velocity joint 213 at the same speed enables the torque from the drive shaft 201 to be transmitted to both the piston block 205 and the constant velocity joint 213. This ensures both the piston block 205 and the constant velocity joint 213 remain angularly aligned. Driving both the constant velocity joint 213 and the piston block 205 reduces the amount of torque transmitted to the piston block 205 since torque is not required be transferred from the piston block 205 to the constant velocity joint 213 to drive rotation of the join 213. The torque transmitted to the piston block 205 is simply the torque it takes to move the piston block 205 alone. The pistons 207 within the piston block 205 are now being reciprocated within the piston block 205 via power from the constant velocity joint 213 (i.e., torque transmitted from the drive shaft 201 through the constant velocity joint 213, the drive plate 206 and the piston shoes 204). The piston block 205 is coupled to the drive shaft 201 by a torque transmitting mechanical interface. The torque transmitting mechanical interface can include a spline arrangement 214*a* providing a connection between the drive shaft 201 at the piston block 205. The piston block 205 also includes a plurality of cylinders 320 receiving corresponding one of the pistons 207, and piston rods 207A that couple the piston shoes 204 to the pistons 207.

The constant velocity joint 213 includes an outer race 210, an inner race 211, and a ball 212 positioned between the inner race 211 and outer race 210. The ball 212 can include a plurality of balls positioned between the inner and outer races 210, 211. The inner race 211 is coupled to the drive shaft 201 by a torque transmitting mechanical interface. The torque transmitting mechanical interface can include a spline arrangement 214*b* providing a connection between the drive shaft 201 and the inner race 211 of the constant velocity joint 213. Therefore, as the drive shaft 201 is being turned, it turns the inner race 211. The inner race 211 is coupled to the ball 212, prompting the ball to turn as the inner race 211 turns. Accordingly, the outer race 210 is coupled to the ball 212, prompting the outer race 210 to turn as the ball 212 turns due to the inner race. Finally, the drive plate 206 is coupled to the outer race 210 of the constant velocity joint 213. As the outer race 212 turns via the ball 212 and the inner race 211 coupled to the drive shaft 201, the drive plate 206 rotates with the shaft 201 about the axis 21. The ball 212 also allows the outer race 210 and the drive plate 206 to be pivoted relative to the inner race 211 and the drive shaft 201 about a CVJ pivot axis 328.

The drive plate 206 includes shoe pockets 322 configured to receive the piston shoes 204. Coupling the drive plate 206 to the outer race 210 enables the piston shoes 204 mounted on the drive plate 206 to rotate about the axis 21 of the drive shaft 201 with the inner race 211 of the constant velocity joint 213. Thus, the piston shoes 204 are carried with the drive plate 206 as the drive plate rotates about the longitudinal axis 21 of the drive shaft 201. Torque is inputted through a torque transfer plane 324 from the drive shaft 201 and transmitted through the constant velocity joint 213 and the drive plate 206 to the piston shoes 204 within the shoe pockets 322. The torque transmitted from the drive shaft 201 to the piston shoes 204 is resolved into an axial pumping force of the piston 207 due to the non-zero angle of the swash plate 208. For example, as the drive shaft 201 rotates about the longitudinal axis 21, pumping force is applied through the piston rods 207A to the pistons 207 causing the pistons to reciprocate within their corresponding cylinders 320. The pistons 207 move through one in-stroke and one out- stroke per rotation of the drive shaft 201. During in-strokes of the pistons 207, fluid is drawn into the corresponding cylinders 320. During out-strokes of the pistons 207, fluid is expelled from the corresponding cylinders 320. The in-stroke and out-stroke pumping action generated during shaft rotation is caused by the angle of the swash plate 208 and the drive plate 206 relative to the drive shaft 201 and the piston block 205. Specifically, the pistons 207 are pushed into their corresponding cylinders during the 180 degree portion of a shaft rotation where the angle of the swash plate 208 causes the swash plate 208 and the drive plate 206 to be closer to the piston block 205. The pistons 207 are pulled out from their corresponding cylinders during the 180 degree portion of a shaft rotation where the angle of the swash plate 208 causes the swash plate 208 and the drive plate 206 to be further from the piston block 205.

The swash plate 208 is enabled to pivot with the drive plate 206 and the outer race 210 relative to the drive shaft 201 about the CVJ pivot axis 328 to allow a stoke length of the pistons to be adjusted. The piston stroke length increases with an increased swash plate angle and decreases with a decreased swash plate angle. A pivotal swash plate mount 202 and bearing 203 enables the swash plate 208 to pivot with the drive plate 206. The swash plate 208 is not rotatable with the drive shaft 201 about the longitudinal axis 21. In a further example, the swash plate 208 can be supported by a cradle 326 that is secured to a housing 330 of the axial-piston pump 20.

The cradle 326 can be configured to allow the swash plate 208 to pivot relative to the drive shaft 201. In this exemplary embodiment, the swash plate 208 can include a convex portion 332 that engages a corresponding concave portion 334 of the cradle 326. The piston shoes 204 positioned within the shoe pockets 322 of the drive plate 206 are supported by and ride on the swash plate 208. The interface between the piston shoes 204 and the swash plate 208 includes a fluid bearing interface (e.g., a hydrostatic bearing). At the fluid bearing interface, fluid bearings 336 are utilized between the piston shoes 204 and the swash plate 208. The fluid bearings 336 reduce friction between the piston shoes 204 and the swash plate 208 so that the drive plate 206 can be efficiently rotated relative to the swash plate 208 about the longitudinal axis 21. The fluid bearings 336 also allow axial reactive load generated by the pumping axial force transmitted through the piston rods 207A to by-pass the drive plate 206. Instead, the axial reactive load is applied through the fluid bearings 336 to the swash plate 208. From the swash plate 208, the axial reactive load is applied through the cradle 326 to the housing 330. By preventing axial loading from being applied to the drive plate 206, bending stress is prevented from being applied to the drive shaft 201 by the drive plate 206.

The piston rod 207A includes a slender intermediate portion 340 that extends between first and second piston heads 207B, 207C positioned at opposite first and second ends of the piston rod 207A. The first piston heads 207B of the piston rods 207A are mounted to universally pivot within the pistons 207. The pistons 207 can include spherical inner pockets that receive the first piston heads 207B of the piston rods 207A. The first piston heads 207B can be shaped as spherical balls. In this way, the pistons 207 couple to the piston rods 207A at ball joints that allow for universal pivoting of the piston rods 207A relative the pistons 207. The second piston heads 207C of the piston rods 207A are also mounted to universally pivot within the piston shoes 204.

In the depicted example, side load has been reduced or eliminated because torque is applied from the drive shaft 201 to both the drive plate 206 and the piston block 205. In this way, torque for generating the axial pumping action need not be applied through the piston block but instead is applied to the piston rods 207A through the constant velocity joint 213, the drive plate 206 and the shoes 204. This type of configuration allows the intermediate portions 340 of the piston rods 207A to be slender. In one example, the intermediate portions 230 have cross-dimensions D1 that are less than 70 percent as large as corresponding diameters D2 of the cylinders 320.

This prevents the intermediate portions 340 from contacting the piston block 205 during shaft rotation and provides enhanced clearance for pivoting during rotation of the drive shaft 201 to accommodate larger swash plate angles. Additionally, because meaningful torque is not transferred from the piston block 205 to the pistons 207, the pistons can be shortened. In certain examples, the pistons 207 have axial-piston lengths L1 that are less than one half or less than one-third as large as corresponding axial lengths L2 of the cylinders 320. In certain examples, the intermediate portions 340 of the piston rods 207A have axial lengths L3 that are longer than the axial-piston lengths L1 or at least two times as long as the axial-piston lengths L1. In certain examples, the swash plate 208 can have a maximum swashplate angle A relative to the longitudinal axis 21 that is at least 18 degrees, or at least 20 degrees, or at least 22 degrees, or at least 25 degrees.

The second piston heads 207C of the piston rods 207A are mounted to universally pivot within their corresponding piston shoes 204. The second piston heads 207C can include spherical balls that mount within spherical pockets defined by their corresponding shoes 204. In this way, the piston rods 207A couple with the shoes 204 at ball joints that allow for universal pivoting of the piston rods 207A relative to their corresponding shoes 204. In one example, the torque transfer plane 324 of the constant velocity joint 213 can intersect the second piston heads 207C of the piston rods 207A. In one example, the torque transfer plane 324 can intersect center points of the second piston heads 207C of the piston rods 207A. In this way, the torque applied to the shoes 204 by the drive plate 206 does not have a moment arm relative to the second piston heads 207C that would cause the shoes 204 to pivot about the second piston heads 207C. The presence of such a moment arm could cause the shoes 204 to tip within their corresponding shoe pockets 322 thereby breaking engagement between axial end faces 342 of the shoes 204 and the swash plate 208. It will be appreciated that such a tipping action of the shoes 204 within their corresponding shoe pockets 322 could cause excessive pressurized fluid to leak from the fluid bearings 336 into the pump casing thereby compromising operation of the pump.

The second piston heads 207C of the piston rods 207A can include spherical portions that mount within spherical pockets defined by the piston shoes 204. Furthermore, the piston shoes 204 can include spherical drive plate engagement portions 344 that engage corresponding spherical shoe engagement portions 346 defined by the drive plate 206. The drive plate engagement portions 344 are positioned at exterior locations of the shoes 204 and extend circumferentially about the exterior s of the shoes 204. The shoe engagement portions 346 surround the drive plate engagement portions 344 and are defined within the shoe pockets 322. The drive plate engagement portions 344 are convex and the corresponding/opposing shoe engagement portions 346 are concave. The corresponding engagement portions 344, 346 can engage one another at an engagement region 348 that forms a torque transfer interface. The pockets 322 of the drive plate 206 can also include non-contact portions 349 where the drive plate 206 does not contact the shoes 204. For example, a gap or open space 350 is provided between the shoes 204 and the non-contact portions 349 such that the piston shoes 204 do not contact the drive plate 206 at non-engagement regions corresponding to the non-contact portions 349 of the pockets 322 of the drive plate 206. The engagement interface between the drive plate 206 and the shoes 204 ensures the piston shoes 204 never loses contact with the swash plate 208 and transmits torque from the constant velocity joint 213 to the piston shoes 204. For example, the engagement interface 348 is configured such that the torque transfer plane 324 passes therethrough and also passes through the second piston heads 207C of the piston rods 207A.

As described above, the drive plate 206 is coupled to the outer race 210 of the constant velocity joint 213; however, in an alternative embodiment, the outer race 210 and the drive plate 206 may be integrated into one continuous body. Therefore, the integrated-drive-plate-and-outer-race may be directly coupled to the ball 212, prompting the drive plate 206 to turn as the ball 212 turns.

Figure 3:
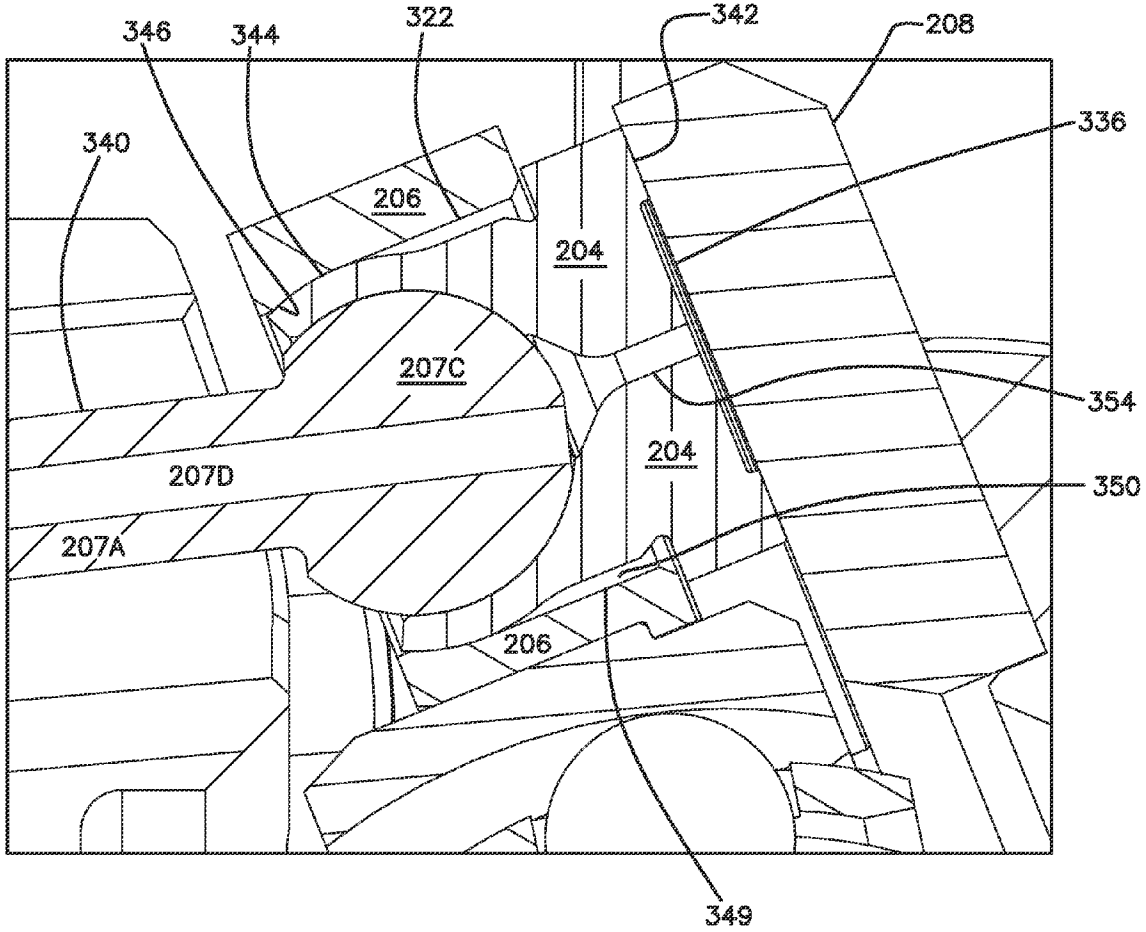
FIG. 3 is a cross-sectional view of a piston rod, including a second head mounted to universally pivot within a shoe in accordance with the principles of the present disclosure.
Figure 4:
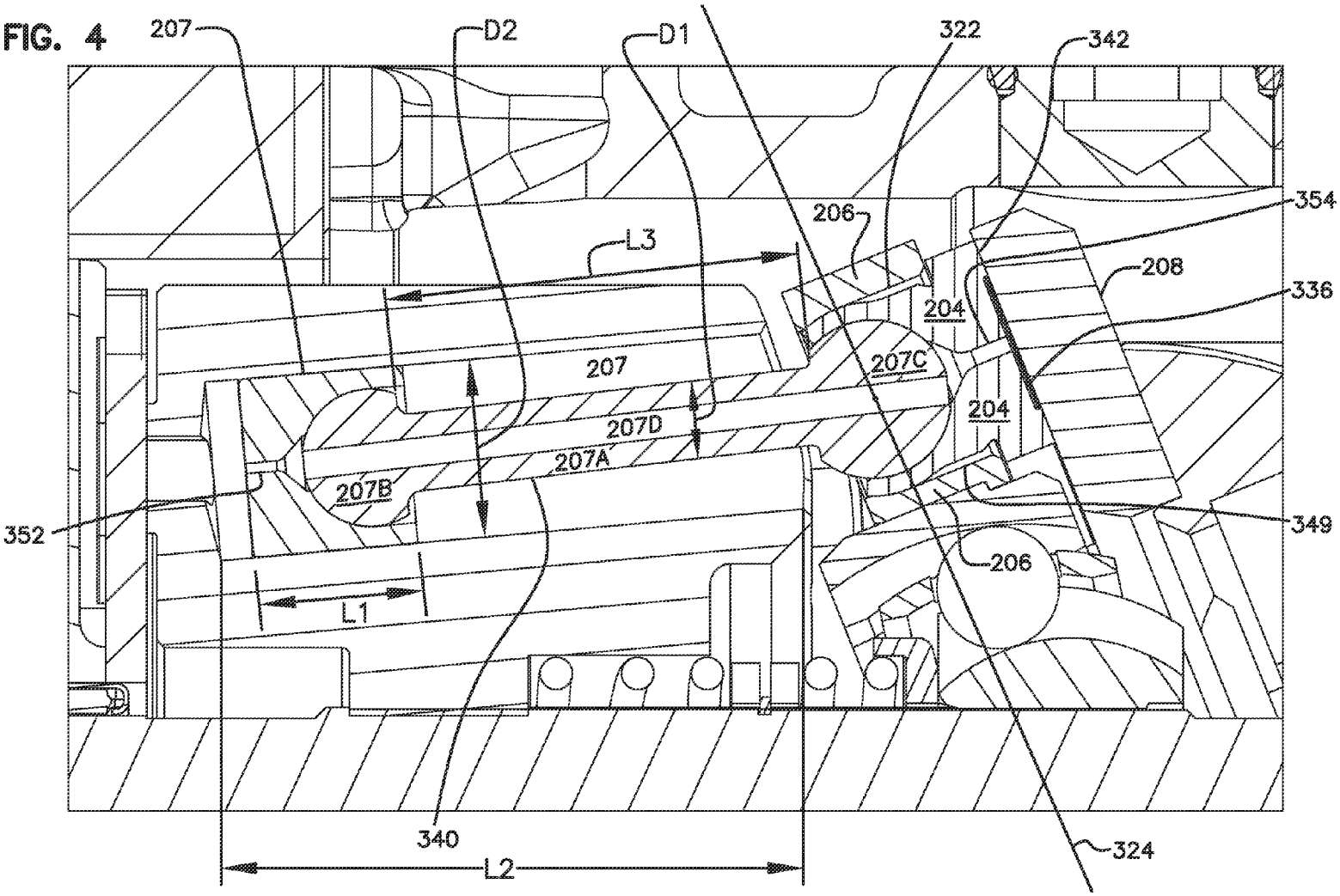
FIG. 4 is a cross-sectional view of a piston in accordance with the principles of the present disclosure.

Referring to FIGS. 3-4, the piston rod 207A includes a longitudinal fluid passage 207D that passes through the intermediate portion 340 and the piston heads 207B, 207C of the piston rod 207A. The pistons 207 define piston ports or passages 352 that provide fluid communication between the cylinders 320 and the longitudinal fluid passages 207D. The shoes 204 define shoe ports or passages 354 that provide fluid communication between the longitudinal fluid passages 207D and the fluid bearings 336. In this way, the longitudinal fluid passages 207D cooperates with the ports 352, 354 to provide fluid communication between the cylinders 320 within the piston block 205 and the end faces 342 of the piston shoes 204. This fluid communication enables the fluid bearings 336 to be pressurized by the fluid pressure from the cylinders 320.

In an exemplary embodiment, due to the constant velocity joint 213, the slender piston rods 207A, and the absence of significant torque transmitted to the pistons 207 via the piston block 205, the maximum non-zero angle of the swash plate 208 can be increased up to thirty, forty or fifty-degrees. Because minimal torque is being transmitted through the piston rods 207A and the pistons 207, the bending stress acting on the pistons 207 is negligible. An increase in the angle of the swash plate 208 enables the axial-piston pump to pump a greater flow at the same shaft speed, creating a larger pump displacement.

The torque inputted to the constant velocity joint 213 is transmitted to the piston shoes 204 through the drive plate 206. More specifically, the torque transfer plane 324 of the constant velocity joint 213 intersects the engagement region 348. The longitudinal fluid passage 207D contains fluid being pumped through the axial-piston pump. The piston shoes 204 and the shoe pockets 322 are designed to balance the second piston heads 207C on the pistons 207 within the piston shoes 204. If the piston shoes 204 lift off or tip over, the hydraulic fluid being pumped through the longitudinal fluid passage 207D will leak into the axial-piston pump 20 case. The axial-piston pump 20 will then produce reduced flow, and as a result, the efficiency will be substantially compromised. Therefore, it is significant that the piston shoes 204 be inhibited from losing contact with the surface of the swash plate 208. The profile of the piston shoe 204, to receive the second piston head 207C at a shoe engagement portion 346, is configured such that the transmitted torque bisects the spherical shoe engagement portion 346 so as to minimize any tipping moment. By minimizing any tipping moment and other forces, the end faces 342 of the shoes 204 are secured against the swash plate 208.

As discussed above, the torque to both the constant velocity joint 213 and the piston block 205 are transferred from the drive shaft 201 via the spline assembly 214. The spline assembly 214 on the drive shaft 201 may be a part of the same extended spline, or separate. The constant velocity joint 213 and the piston block 205 preferably turn at the same speed however, to ensure no unintended torque is being applied on the pistons 207, and to ensure no contact occurs between the slender piston rods 207A and the cylinders 320.

Figure 5:
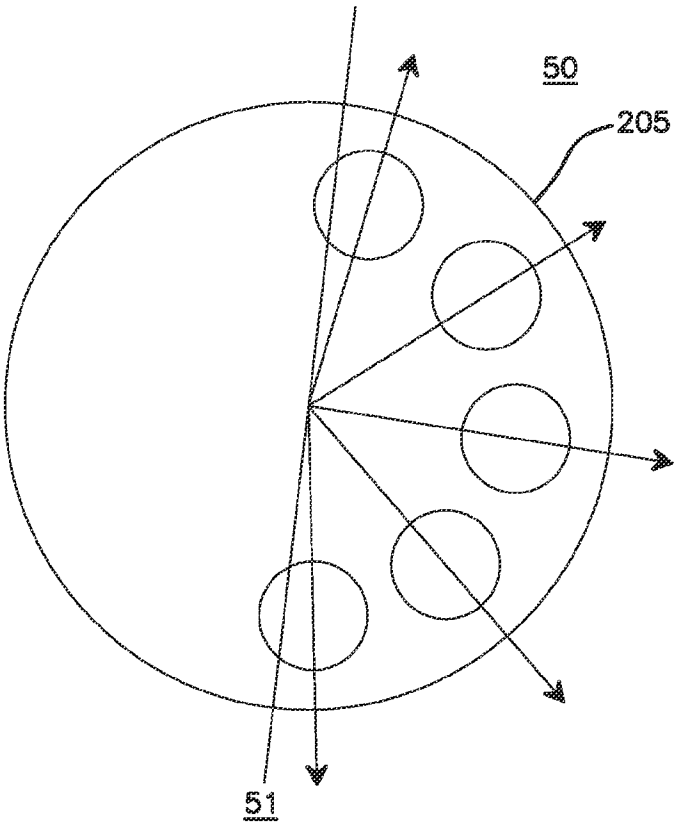
FIG. 5 is a schematic of forces on the piston rods within the axial-piston pump in accordance with the principles of the present disclosure.

FIG. 5 is a schematic of forces on the pistons within the axial-piston pump 50 in accordance with the principles of the present disclosure. The axial-piston pump 50 typically contains up to nine pistons, where either four or five pistons are alternatively exposed to full pressure or the load pressure. The center axis 51 dividing the axial-piston pump 50 in half displays five pistons to the right of center axis 51. The five pistons displayed are exposed to full pressure, meaning, the five pistons are pushing fluid outward as they circle around the drive plate. The four pistons (not shown) are drawing fluid inward. As the fluid is being pushed outward, a side force is being generated, and applied to the piston block radially outward in the direction of the five arrows corresponding with the pistons to the right of center axis 51. The side load due to one piston is no more than one hundred-thirty five newtons. Essentially, the five forces are pushing the cylinder barrel to the side in five directions. The five forces can be combined into a moment arm, and the moment arm, exposed to load pressure, is tending to tip the piston block over. The moment arm acts at a point of intersection of the drive shaft axis with a plane passing through the first head of the piston rod. The moment arm reflects the force acting on the piston block due to the five pistons exposed to the load pressure. The tipping force is reduced significantly due to the dual torque transmission through the piston block and the constant velocity joint. The tipping moment on the piston block due to the load pressure is no more than twenty-five newton-meters.

The hydrostatic balance of the piston block is designed to counteract this tipping moment. A spring 360 located on the drive shaft 201 is in its compressed state, and exerts force axially along the drive shaft. The axial spring force counteracts the tipping force at a 90-degree angle of the moment arm. With the inclusion of the constant velocity joint assembly, the spring 360 located on the drive shaft 201 need not exert a massive amount of force as a result of the reduced tipping force.

It will be appreciated that the various operating environments depicted herein are exemplary and explanatory only and are not restrictive of the broad concepts upon which the examples disclosed herein are based.

What is claimed is:

1. An axial piston device comprising:

a drive shaft that rotates about a longitudinal drive axis;

a piston block having an interior coupled to the drive shaft by a first torque transmitting mechanical interface such that the piston block rotates with the drive shaft about the longitudinal drive axis, the piston block defining a plurality of cylinders;

pistons positioned within the cylinders, the pistons being reciprocally movable within the cylinders;

a constant velocity joint including an inner race, an outer race and ball bearings positioned between the inner and outer races, the inner race being coupled to the drive shaft by a second torque transmitting mechanical interface such that the constant velocity joint rotates with the drive shaft about the longitudinal drive axis , the ball bearings being configured to transfer torque from the inner race to the outer race, and the ball bearings being configured to allow the outer race to pivot relative to the inner race and the drive shaft;

a drive plate coupled to the outer race of the constant velocity joint such that the drive plate rotates with the constant velocity joint about the longitudinal drive axis, the drive plate defining a plurality of shoe pockets, and the drive plate being mounted to pivot with the outer race relative to the drive shaft;

a swash plate configured to pivot with the drive plate and the outer race relative to the drive shaft, the swash plate not being rotatable with the drive shaft;

shoes positioned within the shoe pockets and carried with the drive plate, the shoes providing a bearing interface with the swash plate;

piston rods having first heads mounted to universally pivot within the pistons and second heads mounted to universally pivot within the shoes, the piston rods defining longitudinal fluid passages that provide fluid communication between the cylinders and the shoes; and wherein fluid bearings are defined between the shoes and the swash plate at the bearing interface, wherein the shoes define shoe fluid passages that provide fluid communication between the longitudinal fluid passages of the piston rods and the fluid bearings such that the fluid bearings are pressurized by fluid pressure from the cylinders.

2. The axial piston device of claim 1, wherein a torque transfer plane of the constant velocity joint intersects the second heads of the piston rods.

3. The axial piston device of claim 1, wherein the second heads include spherical portions that mount within pockets defined by the shoes, and wherein the shoes include spherical drive plate engagement portions that engage corresponding spherical shoe engagement portions defined by the drive plate at an engagement region.

4. The axial piston device of claim 3, wherein the pockets of the drive plate include non-contact portions, and wherein open space is defined between the shoes and the non-contact portions such that the shoes do not contact the drive plate at a non-engagement region corresponding to the non-contact portions of the pockets of the drive plate.

5. The axial piston device of claim 4, wherein the non-contact portions of the pockets are not spherical.

6. The axial piston device of claim 4, wherein a torque transfer plane of the constant velocity joint intersects the engagement region.

7. The axial piston device of claim 1, wherein the swash plate is supported by a cradle that is secured to a housing of the axial piston device and that is configured to allow the swash plate to pivot relative to the drive shaft.

8. The axial piston device of claim 7, wherein the swash plate includes a convex portion that engages a corresponding concave portion of the cradle.

9. The axial piston device of claim 1, wherein the cylinders have cylinder lengths, and wherein the pistons have axial piston lengths that are less than one half as long as the cylinder lengths.

10. The axial piston device of claim 9, wherein the piston rods include elongated intermediate portions that extend between the first and second heads, wherein the elongated intermediate portions are longer than the axial piston lengths, wherein the cylinders have cylinder diameters, and wherein the elongated intermediate portions have cross-dimensions that are less than 70 percent as large as the cylinder diameters.

11. The axial piston device of claim 10, wherein the swash plate has a maximum swash plate angle greater than 18 degrees.

12. The axial piston device of claim 10, wherein the swash plate has a maximum swash plate angle greater than 20 degrees.

13. The axial piston device of claim 1, further comprising a spring that applies a compressive axial load against the piston block.

14. The axial piston device of claim 13, wherein the spring is aligned along the longitudinal drive axis and is positioned between the piston block and the constant velocity joint.

* * * * *